United States Patent [19]

Roos

[11] Patent Number: 4,954,674

[45] Date of Patent: Sep. 4, 1990

[54] MATRIX CROSSPOINT SWITCHING DEVICE

[75] Inventor: Sture G. Roos, Bergshamra, Sweden

[73] Assignee: Telefonaktiebolaget L M Ericsson, Stockholm, Sweden

[21] Appl. No.: 354,432

[22] PCT Filed: Sep. 2, 1988

[86] PCT No.: PCT/SE88/00452

§ 371 Date: May 10, 1989

§ 102(e) Date: May 10, 1989

[87] PCT Pub. No.: WO89/02650

PCT Pub. Date: Mar. 23, 1989

[30] Foreign Application Priority Data

Sep. 10, 1987 [SE] Sweden ..... 8703521

[51] Int. Cl.[5] ..... H01H 1/16; H01H 67/26

[52] U.S. Cl. ..... 200/175; 200/177

[58] Field of Search ..... 200/175–178, 200/DIG. 29; 335/108, 109, 111–113; 361/416

[56] References Cited

U.S. PATENT DOCUMENTS

| | | | |
|---|---|---|---|
| 2,647,166 | 7/1953 | Lens | 200/177 |
| 2,997,557 | 8/1961 | Gillmor et al. | 200/61.45 M |
| 3,354,434 | 11/1967 | Shlesinger, Jr. | 200/1 R X |

FOREIGN PATENT DOCUMENTS

| | | |
|---|---|---|
| 1194402 | 11/1959 | France . |
| WO84/04200 | 10/1984 | PCT Int'l Appl. . |

*Primary Examiner*—J. R. Scott

*Attorney, Agent, or Firm*—Burns, Doane, Swecker & Mathis

[57] ABSTRACT

A matrix crosspoint switching device makes, breaks, or switches contact between a plurality of first conductor pairs and a plurality of second conductor pairs. The device includes a connection block which includes a plurality of cavities containing crosspoints of the pluralities of conductor pairs. Pairs of conductive and non-conductive roller elements are also contained in the cavities for selectively making, breaking, or switching contacts between the conductor pair crosspoints.

12 Claims, 10 Drawing Sheets

| Comb.sheet | K2 | | K4 | | K6 | | K8 | | Free ball | |
|---|---|---|---|---|---|---|---|---|---|---|
| Pos. | L. | R. | L. | R. | L. | R. | L. | R. | row | col. |
| | X | | X | | X | | X | | 4 | 4 |
| | X | | X | | X | | | X | 4 | 2 |
| Fig.19 | X | | X | | | X | X | | 4 | 3 |
| | X | | X | | | X | | X | 4 | 1 |
| | X | | | X | X | | X | | 2 | 4 |
| | X | | | X | X | | | X | 2 | 2 |
| | X | | | X | | X | X | | 2 | 3 |
| | X | | | X | | X | | X | 2 | 1 |
| | | X | X | | X | | X | | 3 | 4 |
| | | X | X | | X | | | X | 3 | 2 |
| | | X | X | | | X | X | | 3 | 3 |
| | | X | X | | | X | | X | 3 | 1 |
| Fig.20 | | X | | X | X | | X | | 1 | 4 |
| | | X | | X | X | | | X | 1 | 2 |
| | | X | | X | | X | X | | 1 | 3 |
| | | X | | X | | X | | X | 1 | 1 |

Fig.18

MATRIX CROSSPOINT SWITCHING DEVICE

The present invention relates to a matrix switching device for providing making, breaking or switching patent between a plurality of first conductor pairs and a plurality of second conductor pairs, where each pair comprises an a and a b conductor. The switching function is arranged so that one or more a conductors in the first pair (the x path) are connected to the a conductors in the second pair (the y path) simultaneously as making or breaking is carried out between one or more b conductors in the first and second pairs (the x path and y path). The device in accordance with the invention can be used as a so-called crossbar switch, both for analogue and digital signals.

BACKGROUND ART

The galvanic connection of electrical signals in so-called crossbar switches is already known. For example, there is illustrated in the French design making 2.447.623 a galvanic crossbar switch with a plurality of incoming conductors in one plane (x) and a plurality of outgoing conductors in another plane (y). The conductors in the x plane and the y plane form a matrix with a plurality of cross points. These cross points can be connected together by activating switching rods at each cross point.

Particularly with access networks in the art of telephony there is a need of automatic, remotely controlled crossbar switches for avoiding sending out personnel for connecting cable pairs in buldings and distribution cabinets. On the station side there is the same problem in switching between different types of service units and in broken-out units for connecting telephone subscribers such as broken-out subscriber stages and line circuits. For these applications galvanic switching is the most suitable method of operation.

Crossbar switches of the kind mentioned above are also desired for enabling measurements on lines, by connecting the measuring equipment galvanically to the line. These crossbar switches must have great reliability, must not malfunction if there is a power failure and must not take any power in an inoperative state. The demands made according to the above on this equipment makes it unsuitable to introduce electronics in the parts which are to provide the connection paths between incoming and departing conductors.

The crossbar switch according to the above mentioned French design patent can indeed be used for the purposes mentioned above, but is limited to making or opening individual, separate cross points in the matrix, and can be only used for low frequencies.

DISCLOSURE OF INVENTION

The present invention relates to a further development of previously known galvanic crossbar switches with the switching function itself between incoming and outgoing conductors in the connection matrix having been improved. Switching can therefore take place galvanically and with a mechanical lock of the set-up connection points. The lock primarily results in that less forces are required for switching (the OFF position to the ON position and vice versa). In addition there is obtained more rapid and reliable operation and a possibility of constructing the switch so that it has smaller dimensions. This also enables high-frequency signals to be switched through the apparatus, thus making it utilizable for digital line systems.

In accordance with the inventive concept, spherical conductive or non-conductive elements, preferably balls, are used as connection elements for providing electrically conductive or non-conductive contact between the x and y conductors in a connection matrix. In the case where the x and y conductors each consist of conductors pairs (a and b conductors), simultaneous switching (closing and opening) of the a and b conductors in a pair can be achieved with the aid of rods which transmits the operating force from one connection site, e.g. the a conductors, to an adjacent connection site, e.g. the G conductors. The spherical embodiment of the connection elements at the cross points enables a large contact pressure to be created with small operating power.

The object of the present invention is thus to provide a switching device with a plurality of cross points where connection takes place using spherical elements, for achieving small friction and thereby low operating force.

The invention is charactierized by the disclosures in the following claims.

BRIEF DESCRIPTION OF DRAWINGS

The switching device in accordance with the invention will now be described in more detail, and with reference to the following figures.

FIG. 18 is a table of combination possibilities;

BEST MODES FOR CARRYING OUT THE INVENTION

The switching device in accordance with the invention includes a total operation block B which has two functions, a contact function involving a connection K and a operating function involving an operation block M having operating parts M1, M2. There are no electronic details included in these parts, and the switching and operating functions are carried out entirely mechanically under the action of solenoids. The function of the electromagnetic power transmission will not be described in detail, since this is not new and can be carried out with known technique.

The connection block K contains a plurality of cavities which will be described later in connection with FIGS. 2–4, in which balls are placed for providing contact between a plurality of incoming conductor pairs and a plurality of outgoing conductor pairs. The incoming conductor pairs are denoted x conductors, i.e. conductors in the x direction, and each pair comprises an a and a b conductor. The outgoing conductor pairs are denoted y conductors, i.e. conductors in the y direction, and similarly comprise an a and a b conductor. The different conductors are arranged with the same spacing as the pins in the cable means to which a device is connected, and can be directly connected, wound or soldered in a printed circuit board according to known principles. The conductors in the x and y directions are here illustrated as wires in the block K, but in practice are made in the form of ribbons placed in grooves or holes in an electrically insulating material. For example, the carcass of the block K can be of plastics, and the conductors are arranged so that a given spacing is kept between the y and x planes in the z direction. The block K therefore comprises two side members and an intermediate member, the side members having the mentioned grooves for the conductors and the intermediate member the cavities.

Figure 1:
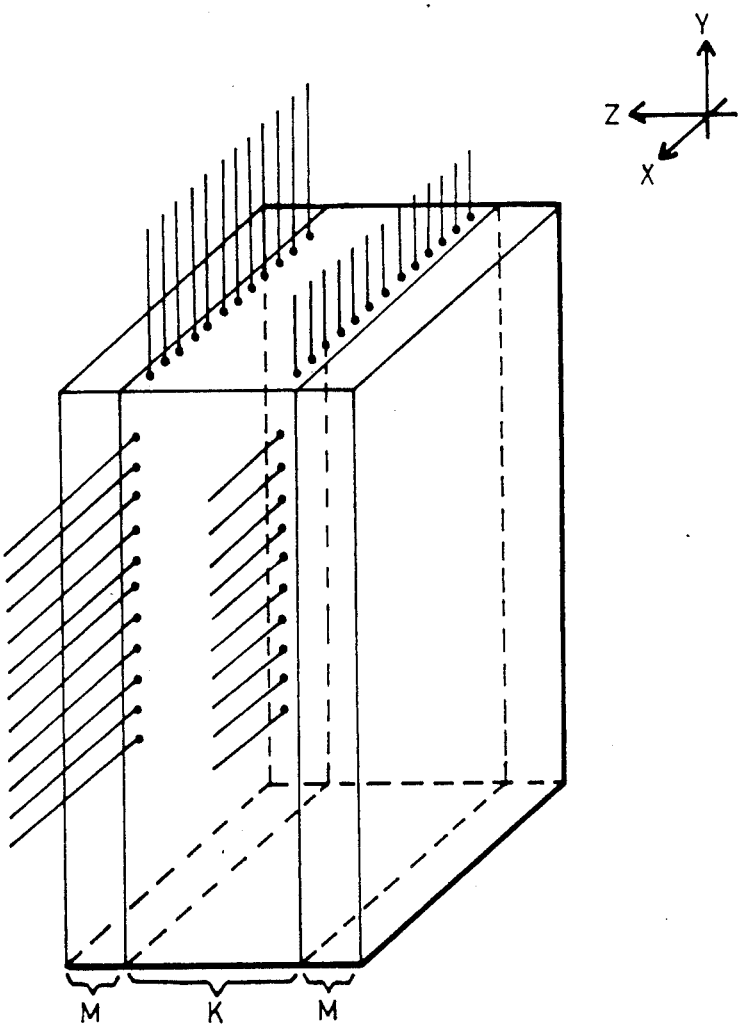
FIG. 1 is a schematic, perspective view of an operation block containing the device in accordance with the invention.
Figure 2:
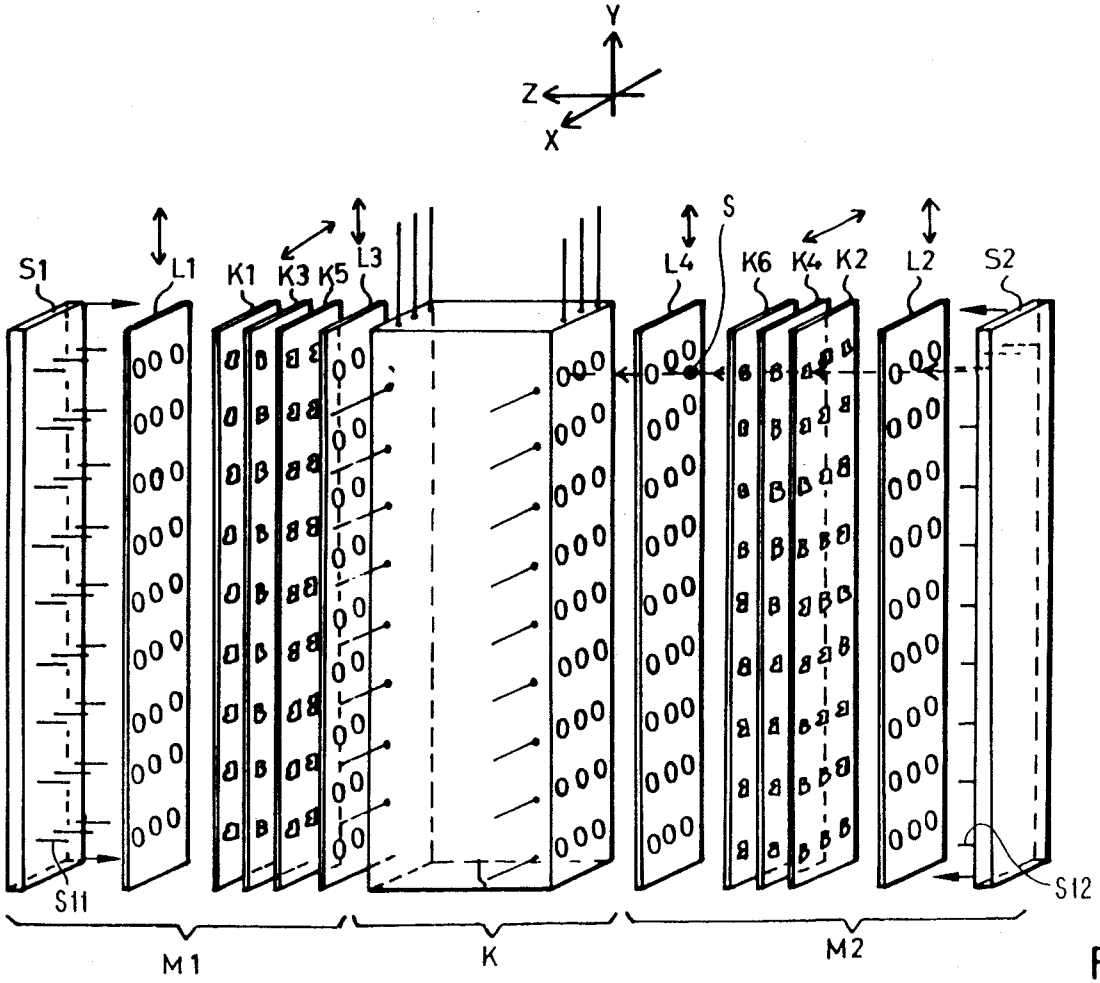
FIG. 2 is a perspective view in more detail of a connection block and the parts in the form of plates included in the operation block of the device according to FIG. 1.

FIG. 2 illustrates more closely in a perspective view the connection block K and operating parts M1, M2 with their different plates placed or arranged symmetrically on either side of the connection block K.

As previously mentioned, the connection block K has a plurality of cavities which is equal to half the number of y conductors, i.e. the number of a or b conductors in the Y direction. Each cavity extends from one side surface of the block K to the opposite side surface, and the openings of the right hand side surface of the block K can be seen from FIG. 2. As will be described in detail in connection with FIGS. 3 and 4, there are two pairs of balls arranged in, and in the vicinity of, each cavity for carrying out the contact function between an x conductor pair and a y conductor pair.

The operation block comprises two identical operating parts M1 and M2, one on either side of the connection block K. The part M1 includes a pin plate S1, an exterior lifting plate L1, a number of combination plates K1, K3, K5, and an inner lifting plate S3. The pin plate S1 is provided with a plurality of pins which are equal in number to the number of cavities in the block K, and which are for actuating the movement of the balls into associated cavities. The pin plate S1 can be moved or displaced sideways according to the arrow. The exterior lifting plate L1 is provided with a plurality of elongate circularly rounded holes, wherein the number of holes is equal to the number of pines in the pin plate S1. The lifting plate L1 can be moved or displaced in height according to the arrow. The number of combination plates (three in FIG. 2) K1, K3, K5, include specially shaped openings for forming one or several selected openings for one or several pins in a direction towards one or more balls, with the object of moving one or more of the balls. These plates, the positions of which determine which ball(s) which is (are) to be moved are displaceable sideways and in height according to the arrows. The inner lifting plate L3 is provided with the same number of circularly rounded off elongate holes as the lifting plate L1, and is displaceable synchronously with the lifting plate L1.

The elongate openings in the lifting plates L1, L3 and the openings of the combination plates K1–K3 are formed and placed in relation to each other such that when the pin plate S1 is moved towards to the connection Block K, an opening is always available for each pin on the pin plate. Each pin on the plate S1 will therefore be able to move freely when the plate is displaced, but only certain selected pins (or only one certain selected pin) will knock against a ball to displace it into the cavity.

The operating parts M2 comprises the same number of plates and is of the same embodiment as the operating parts M1. The plates L2, L4 thus correspond to the plates L1 and L3, and the combination plates K2, K4, K6 correspond to the combination plates K1, K3, K5. A ball has also been illustrated in FIG. 2 in front of a cavity in row 1, colum 1. The ball is kept in position by the lifting plates L2, L4, and the combination plates K2, K4, K6 are positioned such that a pin in the corresponding position on the pin plate S2 has a free path through these plates for enabling it to thrust the ball into the cavity, as will be described below.

Figure 3:
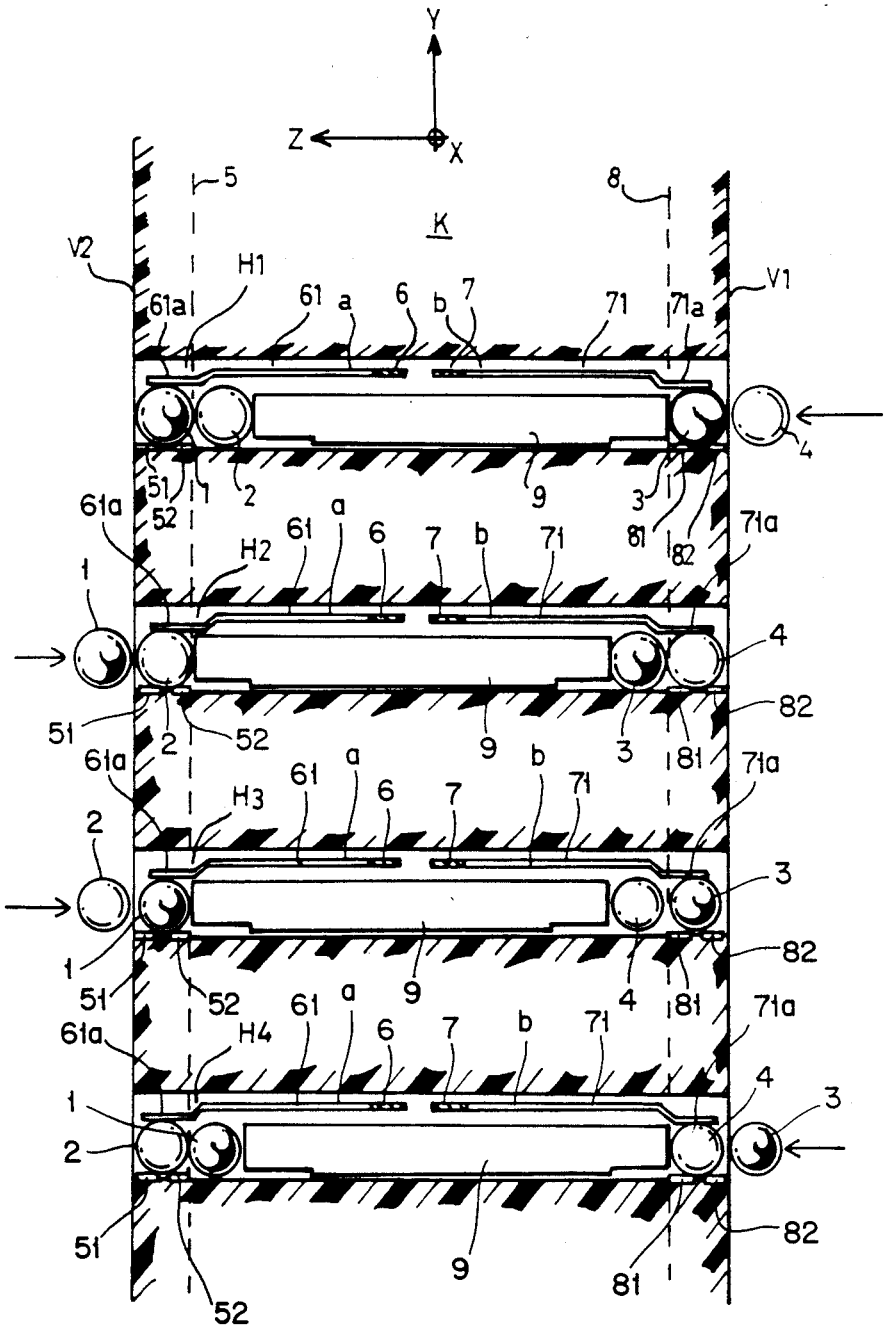
FIG. 3 is a longitudinal section of an embodiment of the connection block included in the device in accordance with the invention.

FIG. 3 is a cross section in the yz plane of an embodiment of the connection block K for a complete two-wire function, e.g. the four first rows in the column of FIG. 2. For each row in a column there is a cavity H1, H2, H3 and H4.

In the cavity H1 there is a first and a second ball 1 and 2, where ball 1 is electrically conductive and ball 2 is electrically non-conductive. In the illustrated position the ball 1 rests on two metal tongues 51 and 52, which extend out into the cavity in the x direction from a y conductor 5 (dashed) which is molded into the block K (illustrated in more detail in FIGS. 5*a,b*). A leaf spring 61 extends out in the z direction from an x conductor 6 which, as with the y conductor 5, is molded into the block K except in the area of the cavity itself. The conductive ball 1 makes contact with an outwardly bent tongue part 61*a* of the spring 61.

At the other side of the cavity there is a conductive ball 3, resting on two metal tongues 81, 82 of the y conductor 8. A leaf spring 71 is bent, like the spring 61, to a tongue portion 71*a*, which engages against the ball. The non-conductive ball 4 in this pair is outside the cavity H1 and is kept in the illustrated position with the aid of the lifting plates L2, L4 of FIG. 2. The displacement of the ball 4 is achieved by a rod 9 having a length and being disposed such that when one pair of balls 1, 2 are accommodated entirely in the cavity H1, the ball in the second pair is outside the cavity. The positions of the balls 1–4 in the cavity H1 is such that contact is established between incoming conductor pairs (a, b) in the x direction and departing conductor pairs in the y direction.

The cavities H2, H3 and H4 are of the same implementation, and the same reference characters have been used. In the cavity H2 the ball 4 (non-conductive) is urged into the cavity by a pin in the corresponding position on the pin plate S2. In this way the ball 3, rod 9 and ball 2 have been displaced to the left in the figure, so that the ball 1 has now come outside the cavity H2 and is kept in position with the aid of the lifting plates L1, L3. The effect of the combination plates K1–K5 lying between the plates L1 and L3 is disregarded for the moment.

Conductive contact between incoming and departing conductor pairs is thus established in the cavities H1 and H3, while non-conductive contact is established in the cavities H2 and H4. Closing or opening thus takes place by moving a conductive or non-conductive ball between the x and the y conductors 6, 7 and 5, 8, respectively, i.e. the balls are moved sideways. By moving the balls, a large contact force is established with the x conductor S61, 71 (which is bent beforehand) with the x conductor being moved up and down more than the tolerances that are between the balls and the x conductors. A large contact pressure can be built up in this way with very short springs. In addition a large air gap can be obtained in the OFF position without movement of the spring on the x conductor. The air gap will be equal to the diameter of the non-conductive ball. The force required to move the balls sideways is the frictional force. It should also be noted that the contact points of the ball and the points on the contacts which break contact are not the same.

The advantage with this is that if there is spark formation on opening, the contact surfaces on the x and y conductors are not affected. It should be further understood that it is improbable that the position of the ball on contact will be the same after an operation, i.e. new contact points are utilized in each operation, which should give increased life to the contact function in relation to conventional relays.

Four conceivable placings of the balls are illustrated in FIG. 3. With the different placings, OFF or ON can be arranged either from the left or the right, with the aid of the left or the right pin plate S1 or S2. In addition, a switching change is obtained simultaneously by moving two contacts. By maneuvering the balls 1 in the cavities H2 and H3 simultaneously, a switching is obtained between two x conductors towards one y conductor. This possibility can be used for accelerating certain functions, since several simultaneous operations can take place.

It should be noted that according to FIG. 3 there is always one ball within the operating parts M1, M2. The contact function can be accomplished with three balls instead of the four illustrated in FIG. 3. The rod 9 can then be replaced by a ball, but for the sake of symmetry all four balls 1–4 have been shown. These can be obtained with very great precision with regard to their diameters.

Figure 4:
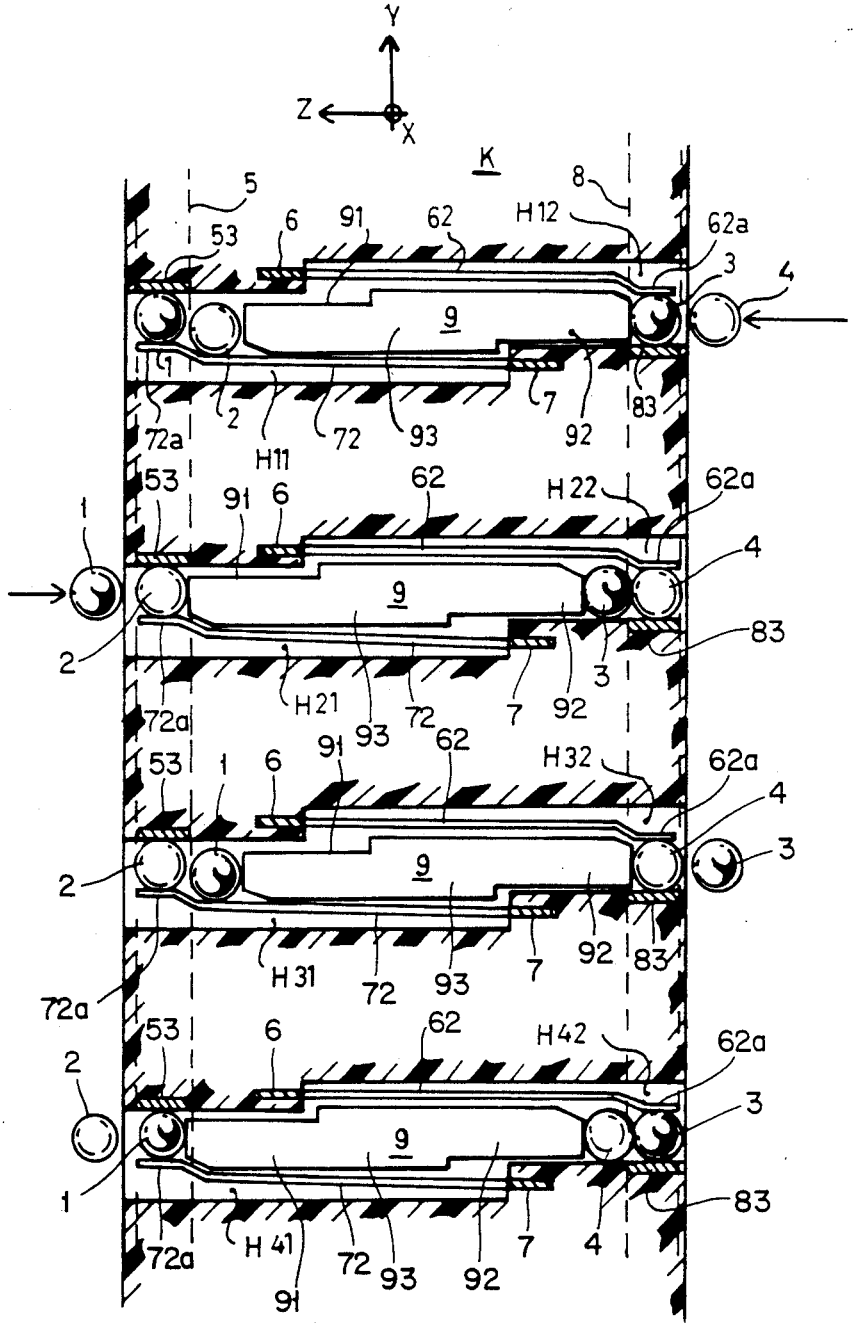
FIG. 4 illustrates another embodiment of the connection block included in the device in accordance with the invention in the same longitudinal section.

In FIG. 4 there is illustrated a second embodiment of the cavities in the connection block K. In this embodiment each cavity comprises two hollow parts, the positions of which have been displaced in the y direction relative each other. The upper cavity in FIG. 4, corresponding to the cavity H1 in FIG. 3, comprises the hollow parts H11 and H12. The cavity part H11 is displaced a distance relative the cavity part H12, or vice versa, at most equal to the diameter of a ball. The rod 9 has also been modified so that it now comprises two end portions 91, 92 that extend out towards the balls 2 and 3 from a central portion 93. The leaf springs 62, 72 from the respective x conductors 6, 7 have also been arranged on either side of the rod 9. The contact surfaces for the wire conductors 5 and 8 have been shown here as single tongues 53 and 83, respectively, but these can also be made as two separate tongues according to FIG. 3. The leaf springs 62 and 72 are bent beforehand, as previously, so that the contact tongues 62*a*, 72*a* are biassed against the balls 1 and 3.

The embodiment according to FIG. 4 is advantageous, since the leaf springs 62, 72 overlap each other on either side of the rod 9, which can thus be made shorter. As a result of this the width of the connection block K can be decreased.

Figure 5A:
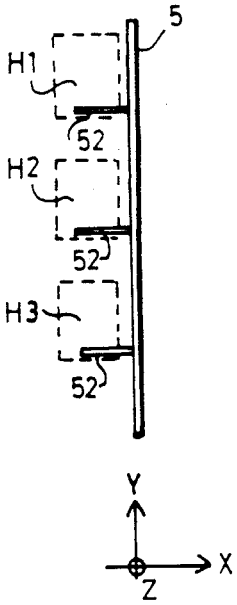
FIGS. 5*a* and 5*b* illustrate an implementation of a y conductor included in the connection block according to FIG. 3.
Figure 5B:
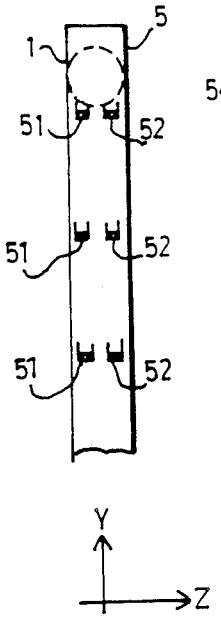
Figure 5C:
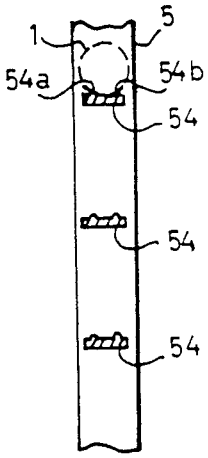
FIG. 5*c* illustrates another embodiment of the y conductor.

FIGS. 5*a*–5*c* illustrate more closely a y conductor, where the FIGS. 5*b*, 5*c* illustrate two different embodiments of the contact surfaces against a ball. The conductor itself comprises a ribbon 5 extending in the y direction in a groove inside the block K. Tongue-like projections forming the contact surfaces have been made by stamping and bending out "tongues" from the ribbon 5. FIG. 5*a* illustrates the ribbon in the z direction.

Each tongue 52 corresponds to a level in the y direction, i.e. level 1 is in the cavity H1 (according to FIG. 3), level 2 is in the cavity H2 etc.

In the same view as FIGS. 3 and 4, FIG. 5*b* illustrates an embodiment of the y conductor where the contact surfaces each comprise two tongues 51, 52, and FIG. 5*c* illustrates an embodiment where the contact surfaces each comprise a single tongue 54 with protuberances 54*a*, 54*b*. In both cases a stable position is ensured for a ball 1 which is in the contact position.

Figure 6:
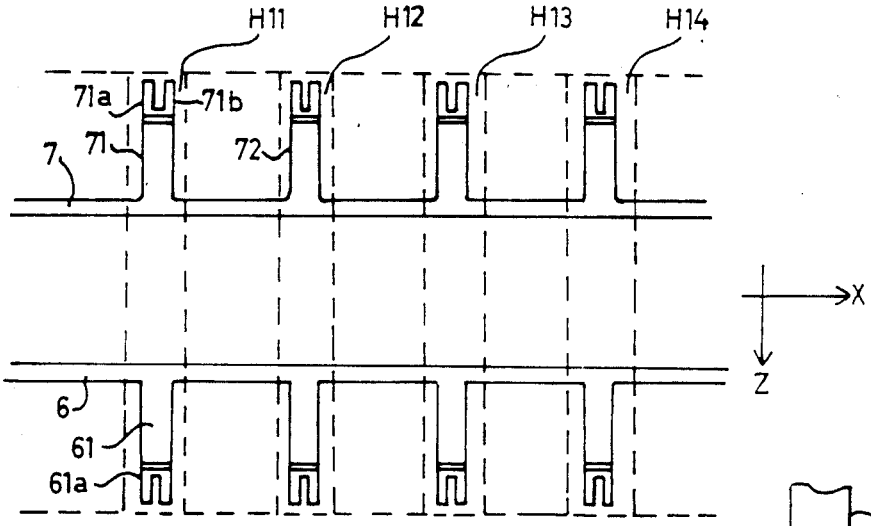
FIG. 6 illustrates an x conductor included in the connection block according to FIG. 3.
Figure 7:
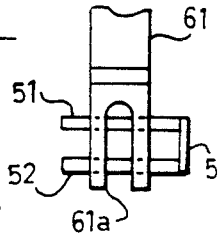
FIG. 7 illustrates an x conductor and a y conductor at a connection point in the block according to FIG. 3.

FIG. 6 illustrates an embodiment of the x conductors for the a and b wires. Each x conductor comprises a ribbon 6, and 7, respectively, extending along the x direction and retained by the material in the connection block K with the aid of specially formed grooves or troughs in the block. However, each ribbon hangs freely in the cavity H1 in FIG. 3. The ribbons 6, 7 are formed with tongues 71, where the spacing between two tongues 71, 72 is equal to the cavity spacing in the connection block K. The end portion of each tongue 71, 72, . . . is bifurcated, and the ensuring parts 71*a* and 71*b* form a stable contact surface for a ball which is in its contact position. FIG. 7 illustrates the point occurring where an x conductor (formed according to FIG. 6) is above a y conductor (formed according to FIG. 5*b*). It will be seen from FIGS. 3 and 4 that there are two such points in each cavity. The y and x conductors illustrated in FIGS. 5*a*–5*c* and 6 are advantageous to use in the embodiments according to FIG. 3 or FIG. 4.

Figure 8:
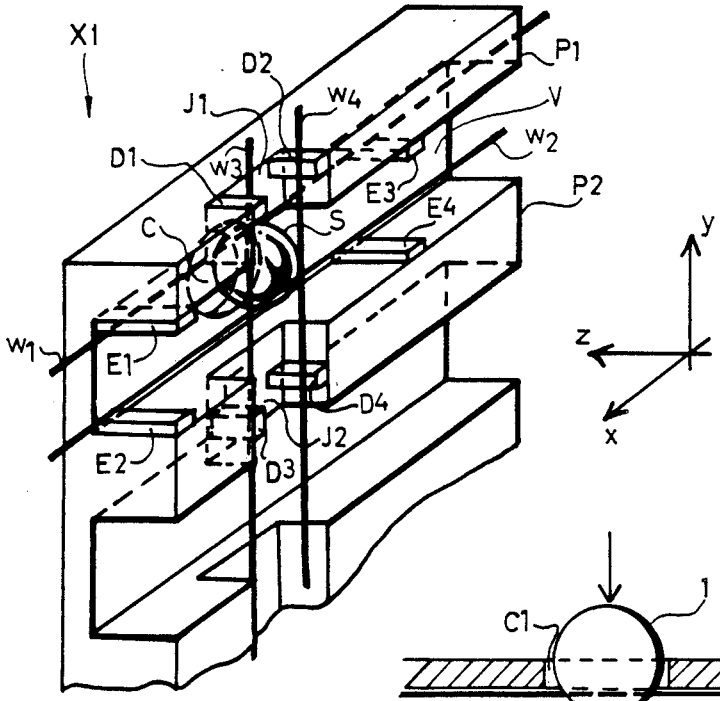
FIG. 8 is a perspective view of a further embodiment of the connection block included in the device in accordance with the invention.
Figure 10:
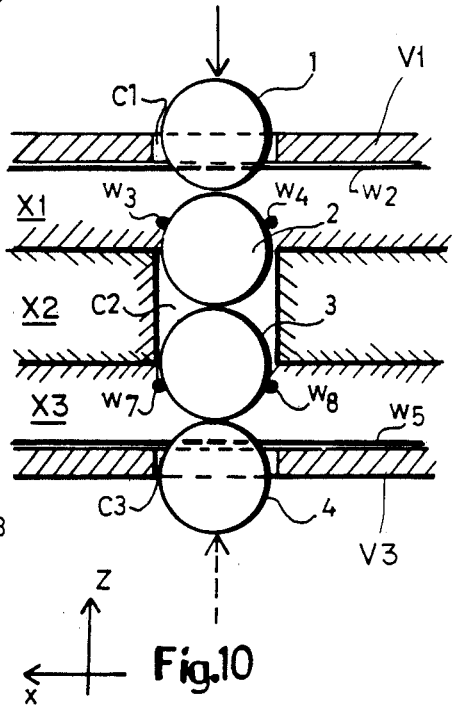
FIGS. 9 and 10 are two different views of details in the connection block according to FIG. 8.

FIG. 8 is a perspective view of a further embodiment of the connection block K. In this case the block comprises three parts X1, X2, X3 of which one part X1 is illustrated in FIG. 8. The parts X1 and X3 comprise outer parts where the part X3 is not shown but is of the same embodiment as the part X1 but mounted oppositely in relation to it on assembly. The part X2 (the cross section which is apparent from FIG. 10) constitutes the central part and is joined to both outer X1, X3. FIG. 10 illustrates more closely how the parts are put together.

FIG. 8 also illustrates the appearance of a cavity in the part K1, and remaining cavities have the same appearance in principle. The cavity comprises partly a space formed between two projecting portions P1 and P2 and partly a first and a second recess J1 and J2 formed in both portions P1 and P2. The recesses J1 and J2 are thus immediately opposite each other in the y direction of the connection block.

In the wall V between the projecting portions P1 and P2 there is a circular opening C, the diameter of which is somewhat larger than the diameter of a ball. The opening C is situated so that its central point lies oposite the lines of symmetry of both recesses.

In the space between portions P1 and P2 there are two wires w1 and w2 arranged so that they extend along the longitudinal direction (the x direction) of the space. The wire w1 engages against the supports E1 and E2, which are fixedly arranged in the upper wall of the space. In a similar way the wire w2 engages against the supports E3 and E4, which are rigidly arranged in the lower wall of the space. The wire pair w1 and w2 are suitably fixed to unillustrated pins arranged along each end surface of the part X1, so that the wires movably engage against the respective support. The wire pair w1 and w2 thus form the a wires in the x direction, while a corresponding wire pair in the other, unillustrated and mirrored part X3 forms the b wires in the x direction.

In a similar way, a wire pair w3 and w4 are arranged in the y direction. The wire w3 engages against fixed supports D1, D3 in one side wall of the recess J1 and J2, respectively, and the wire w4 engages against fixed supports D2, D4 in the opposing side wall of the recess J1, J2. Both wires w3, w4, as with the wires w1 and w2, are rigidly clamped with the aid of pins to the end surfaces (not illustrated here) of the connectgion part X1. If the width of both recesses is equal to the height of the space between the both projecting portions P1 and P2, the wires w1, w2 and w3, w4 will form a substantially quadratic "window" in front of the opening C. However, the wire pair w1, w2 is displaced in the z direction relative the wire pair w3, w4, since both wire pairs shall not make contact with each other if there is no ball between the opening C and the wire pair. In FIG. 8 a ball S is illustrated, and this ball has been thrust in via the opening C and has assumed a position between the inner mouth of the opening at the wall V and one wire pair w1, w2.

Figure 9:
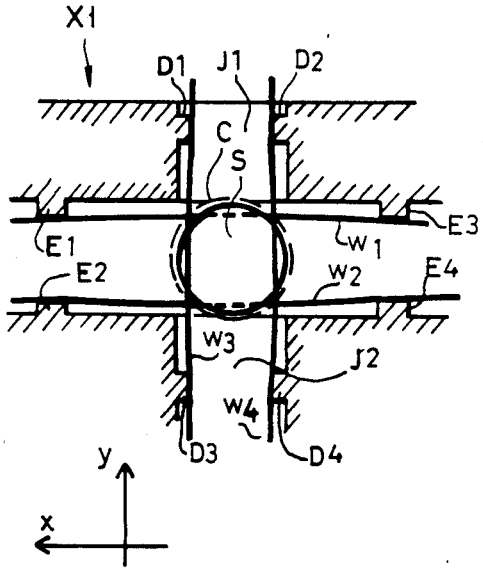

FIG. 9 is a view in the z direction of the connection block part K1. Both wire pairs w1, w2 and w3, w4 engage against their supports E1–E4 and D1–D4. The ball S has been moved so that it has moved the wire pair w1, w2 (which engages against the ball S behind it) away. The wire pair w3, w4 engages against the ball S in front of it. The ball S has thus been moved so that it no longer engages against the circular inner edge of the opening C, but is retained by the wires w1–w4 and is just about the penetrate into the opening of the central part K2 (which will be seen from FIG. 10).

FIG. 10 is a view from above in the y direction according to FIG. 8, with four balls 1–4. In this FIG. will be seen the position of the three parts X1–X3 of the connection block K, these parts engaging tightly against each other in their respective xy planes. The part X2 is provided with circular openings, of which one is illustrated in FIG. 10, and which has the same diameter as the opening C in the parts X1, X3.

A ball 1 is illustrated in FIG. 10, this ball having been moved under the action of a pin on the above-described pin plate a distance into the opening C1 (corresponding to the opening C in FIG. 8) and has thus displaced the ball 2. This ball was in the position according to FIG. 8, i.e. between the wire "window" w1–w4 and the inner edge of the opening C1, before it was indirectly acted on by the pin via the ball 1 to locate this position. In turn the ball 2 has displaced the ball 3 from its position inside the cavity C2 against the wires w7–w8 in the "wire-window" w5, w6, w7, w8 and the ball 3 has displaced the ball 4 from these wires and out through the opening C3.

It is assumed that the ball 1 and the ball 3 are electrically conductive, while the ball 2 and ball 4 are electrically non-conductive. Furthermore the wire pairs are denoted as follows:

$$w1,'=a_y\ w3,w4=a_x \text{ and } w5,w6=b_y\ w7,w8=b_x$$

In the initial position the ball 1 lies entirely outside the block X1, ball 2 makes contact with $a_x$, $a_y$, the ball 3 is entirely in the cavity C2 and the ball 4 makes contact with $b_x$, $b_y$.

On being acted on by the pin, the ball 1 will establish conductive contact between $a_x$ and $a_y$, the ball 2 will be displaced into the opening in the cavity C2, the ball 3 will establish conductive contact between $b_x$ and $b_y$ and the ball 4 will come outside the opening C3. There is thus obtained a two-pole closure or connection of the a and b conductors. When the pin acts on the ball 4 in the opposite direction (dashed arrow) there is obtained a two-pole opening or interruption.

Figure 11:
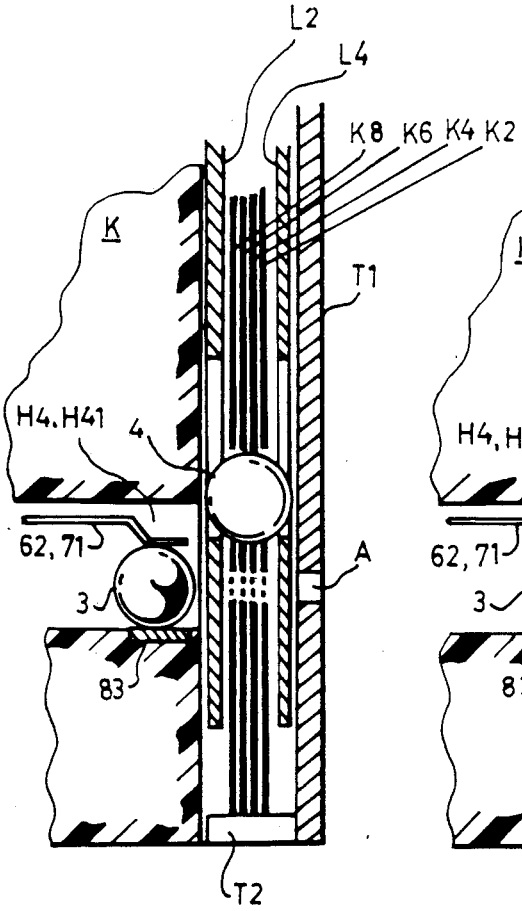
FIGS. 11 and 12 are cross sections in more detail of a part of the connection block according to FIGS. 4; and the operation block of the device in accordance with the invention.
Figure 12:
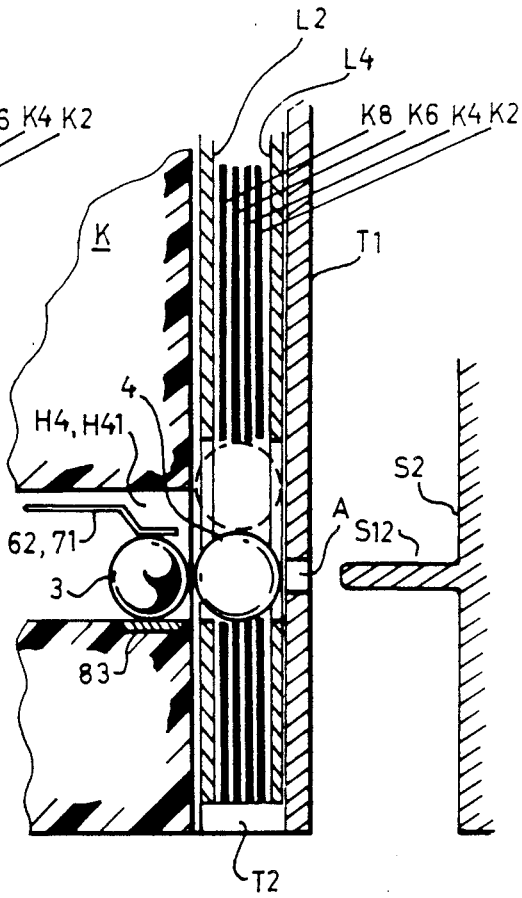

The FIGS. 11 and 12 illustrate, in the same cross sectional view as FIGS. 3 and 4, the right-halnd part of the connection block K and the plates in the operating part M2 which are to the right of the connection block. The details of the connection block have the same characters as in FIGS. 3 and 4 and the different plates in the operating part M2 have the same characters as in FIG. 2.

FIG. 11 illustrates an initial position with a non-conductive ball 3 in contact with the two contact surfaces 62, 71 and 83 for the x conductor and y conductor, respectively, in the cavity H4 or H41 (FIGS. 3 or 4). The ball (conductive) lying outside the connecting block K is kept in its position by the outer and the inner lifting plate L2 and L4. There are four combination plates illustrated in FIGS. 11 and 12, and these can be controlled to move in the vertical plane and in the x direction, as will be more closely described in connection with FIGS. 14–15. The lifting plates L2 and L4 can be quided to move in a vertical plane in the y direction, i.e. up and down in FIGS. 11 and 12. An outer support plate T1 and a lower support plate T2 keep the operating plates in their vertical positions. A pin S12 on the pin plate T1 for moving the ball 4.

In the position according to FIG. 11 the lifting plates L2, L4 are in their upper position and have raised the ball 4. The position of the pin plate in the z direction is such that the pin S12 is to the right of the support T1. This is the initial position for the crossbar switch in its entirety. Here the ball 4 bears against both inner downward edges of the openings in the lifting plates L2, L4. The positions of the combination plates K3, K4, K6 and K8 in the x direction can now be set.

Figure 19:
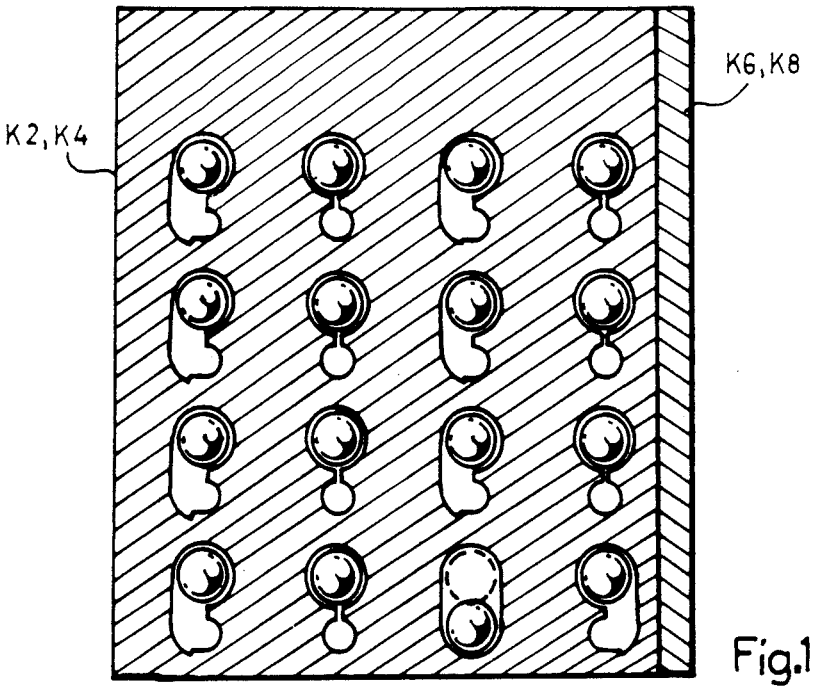
FIG. 19 and 20 illustrate two different combinations using the plates according to FIGS. 14–17.
Figure 20:
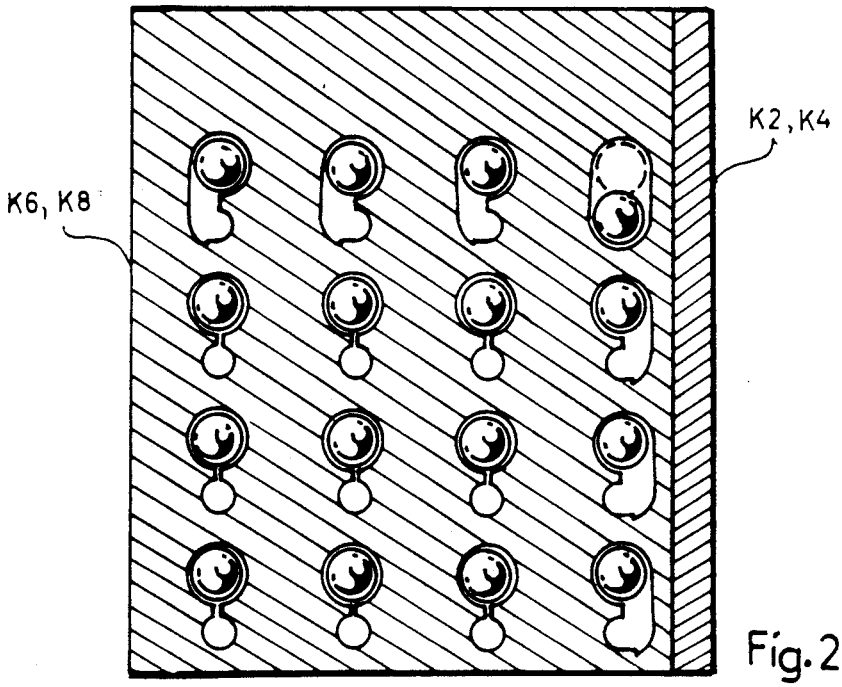

In the position according to FIG. 12, the lifting plates L2, L4 have been lowered in the y direction when the combination plates K2, K4, K6 and K8 have assumed their positions, and it is assumed that, switching from non-conductive to conductive state is to be carried out for the cavity H4 (or H41). The combination plates K2–K8 thus form an opening in the z direction (c.f. FIGS. 19–20) of sufficient size for the ball 4 to fall down and assume the lower position according to FIG. 12. After this operation, the pin S12 can be moved in the z direction after actuation of the pin plate S2, such as to move the ball 4 towards the ball 3. When the pin is moved the ball 4 will displace the ball 3 so that the latter glides or possibly rolls out of its contact position according to FIG. 11, and the ball 4 now assumes this position and conductive contact is established. The ball 3 will thus move the rod 9 as previously described.

For a given operating combination of the combination plates K2–K8 enabling these to be moved or not moved in the x direction, an opening for one or more balls will be formed so that one or more pins on the pin plate S1 and S2 can move the ball or balls to achieve contact changes. These combinations of the combination plates are more closely apparent from the FIGS. 14–15, 19–20.

Figure 13:
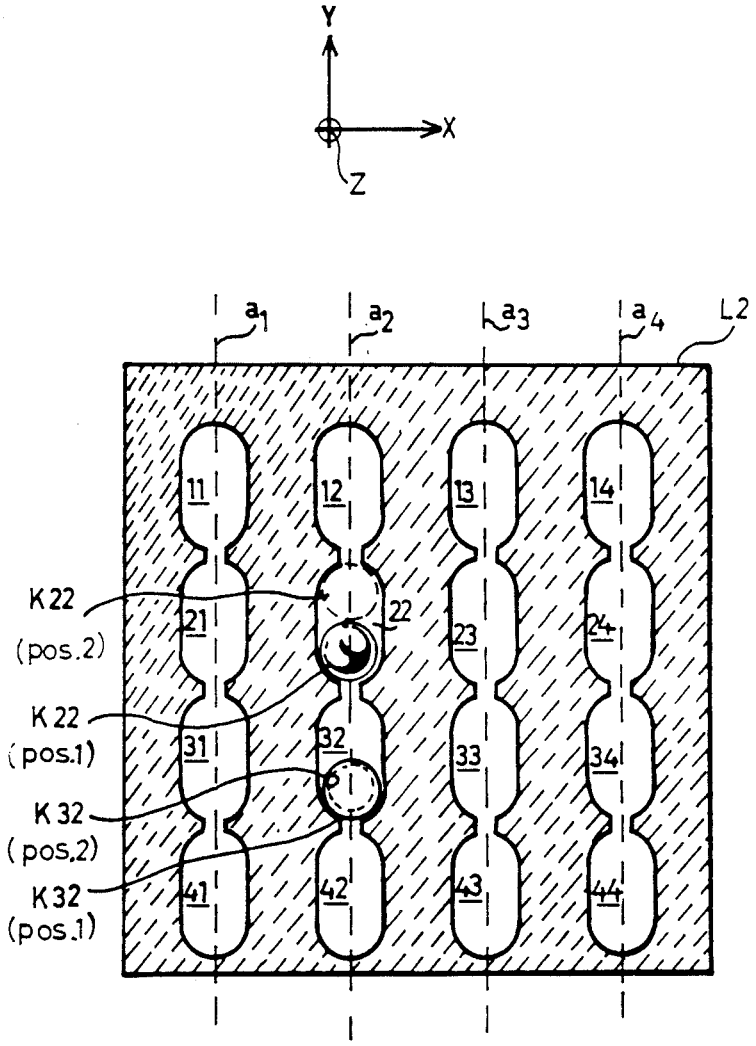
FIG. 13 illustrates a lifting plate included in the operation block according to FIGS. 11 and 12.

FIG. 13 illustrates a lifting plate, e.g. L2, seen directly from the front (the z direction). In this case the plate L2 has sixteen openings 11–14, 21–24, 31–34 and 41–44, arranged in four rows and four columns, with the openings in each column symmetrical about the respective axis of symmetry $a_1$, $a_2$, $a_3$ and $a_4$. Each of the openings 11–14, 21–24, 31–34 and 41–44 shall, together with corresponding openings in the lifting plate L4, serve as fixation and support for the balls which are outside the respective cavity according to FIGS. 11–12. In FIG. 13 only two balls K22 and K32 are illustrated, for the sake of simplicity, but the balls in remaining openings have the same position in the openings.

The lifting plate L2 (as with the plate L4) is displaceable in the y direction. FIG. 13 shows the upper position (position 1) of the plate according to FIG. 11, when the balls K22 and K32 are kept in their upper positions. When the plate L52 is displaced downwards (in the negative y direction), the balls K22 and K32 can fall down so that they come into position " in front of the respective cavity according to FIG. 12. However the ball K22 is prevented from falling down because of the setting of the combination plates.

In a view from the front (the z direction) the FIGS. 14–17 show the four different combination plates K2, K4, K6 and K8 in the operation block described in connection with FIGS. 2, 8 and 9. The combination plates K1, K3, K5 and K7 on the other side of the connection block K are of the same appearance.

Figure 14:
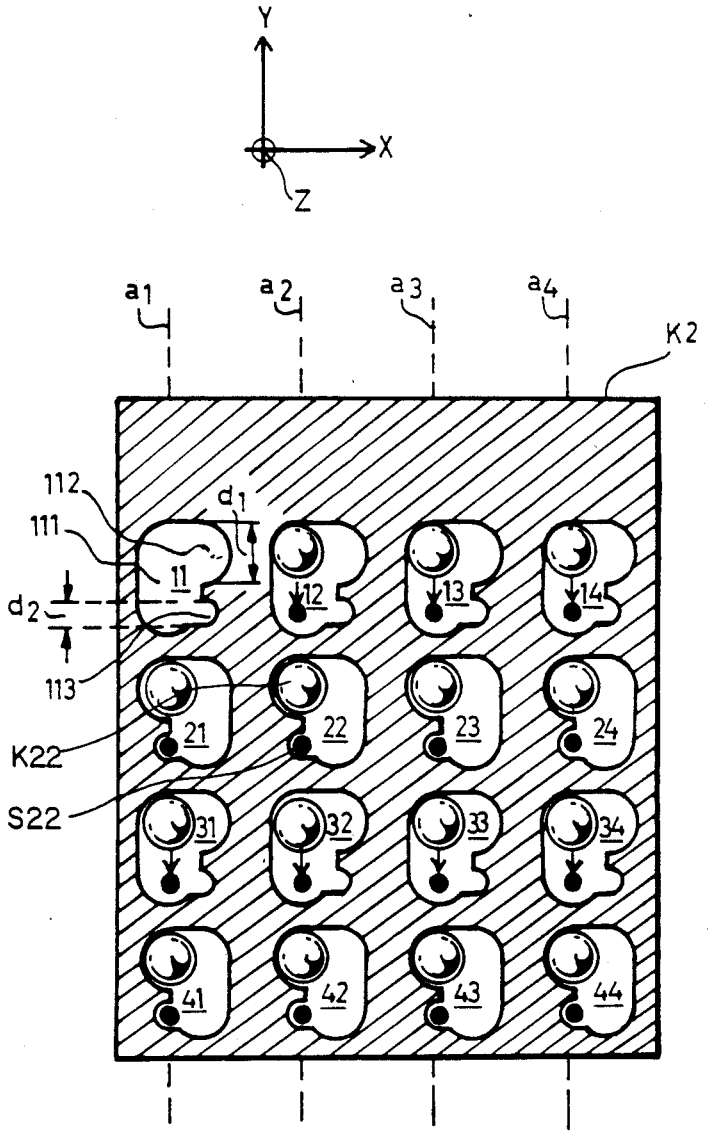
FIGS. 14–17 illustrate different combination plates included in the operation block.

According to FIG. 14, the combination plate K2 lying closest to the lifting plate L2 has sixteen openings 11–14, 21–24, 31–34 and 41–44 arranged in four rows and four columns. the number of the openings can of course be greater or less than shown here. Each opening, e.g. the opening 11 comprises an elongate opening part 111 in the y direction, the dimension of this part being in substantial agreement with the dimension of an opening in the lifting plate L2, L4. In addition, the opening 11 is formed with an elongate upper and lower part 112 and 113 in the x direction. The part 112 has a width $d_2$, which is somewhat greater than the diameter of a pin on the pin plate S2 (see FIGS. 2 and 12). The distance d between two openings 11 and 12, i.e. the spacing, is equal to the spacing of the cavities and is the same as the spacing between the pins on the pin plate S2.

According to FIG. 14 the openings 11–14 and 31–34 in the first and third rows are oriented to the right, i.e. the upper (wider) part 112 and the lower (narrower) part 113 are directed to the right, while the openings 21–24 and 41–44 are oriented to the left.

Figure 15:
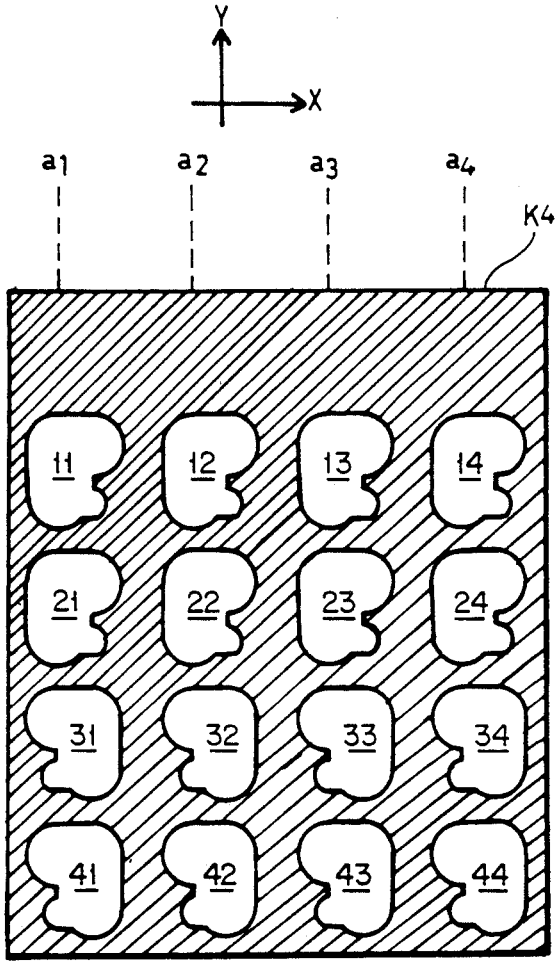
Figure 16:
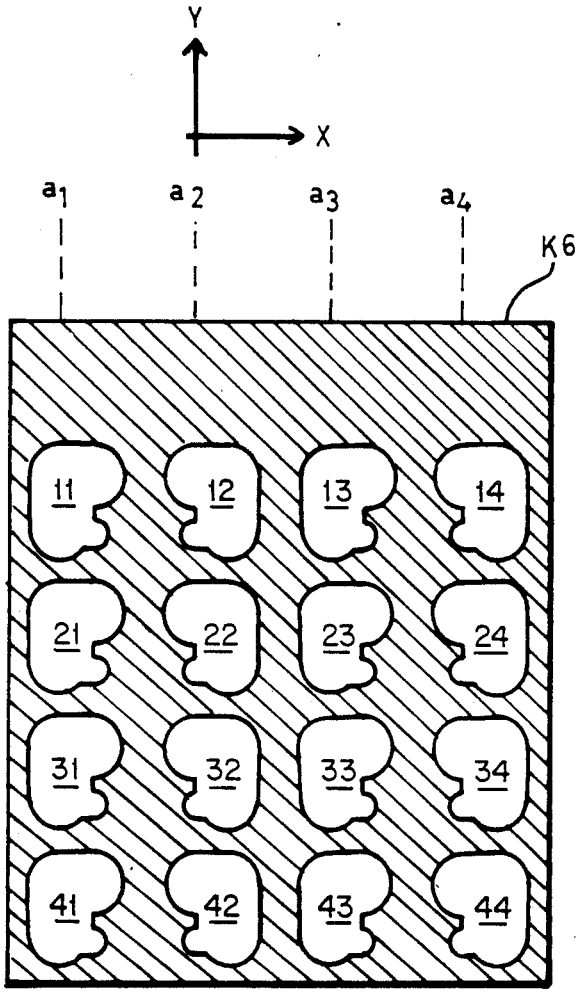
Figure 17:
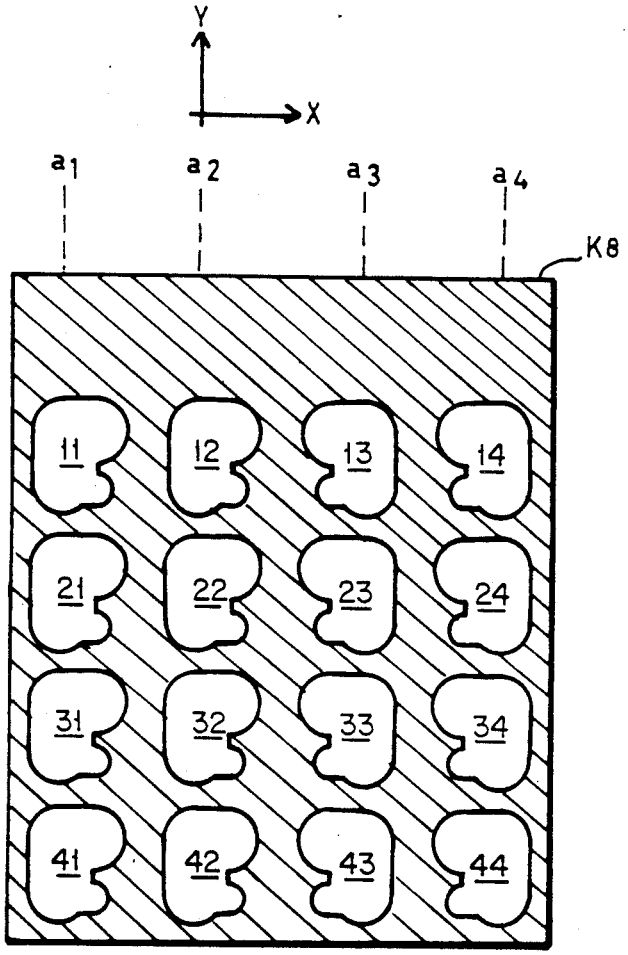

The combination plate K2, as with remaining combination plates K4, K6 and K8 according to FIGS. 15–17, can be moved sideways (in the x direction) to form openings, so that a ball lifted by one of the lifting plates L2, L4 can fall down in front of a cavity. In FIG. 14 the combination plate K2 is in its left position relative the symmetry axes $a_1$–$a_4$. This results in that when the lifting plate L2 according to FIG. 10 is thrust downwards all the balls in rows 1 and 3 can fall down, while the balls in row 2 and 4 are retained. When the plate K2 is moved to its right-hand position, relative the axes $a_1$–$a_4$, the balls in the rows 2 and 4 will fall down instead, while the balls in rows 1 and 3 are retained (not shown in FIG. 14).

The combination plate K4 according to FIG. 15 has openings oriented such that the openings 11–14 and 21–24 in the first and second rows are oriented to the right, while the openings 31–34 and 41–44 in the third and fourth rows are oriented to the left.

According to FIG. 16, the plate K6 has its openings in the columns 1 and 3 oriented to the right, while the openings in the columns 2 and 4 are oriented to the left. According to FIG. 17, the plate K6 has its openings in columns 1 and 2 oriented to the right and its openings in columns 3 and 4 oriented to the left. The position of all the combination plates according to the FIGS. 11–14 is related to the symmetrical axes $a_1$–$a_4$ of the openings according to FIG. 13 of the lifting plates L2, L4.

By moving the combination plates to the left or right in the x direction in relation to each other, openings corresponding to the opening port 111 in FIG. 14 can be formed, in each of which a ball can fall down in front of its associated cavity. There is described below, as an example, both the cases where only one, two, three or all combination plates K2, K4, K6 and K8 assume their left and respective right end positions.

Left end position

Plate K2 by itself: All balls in rows 2 and 4 fall down.

Plates K2, K4 and K6: Balls in row 4, columns 2 and 4 fall down.

Plates K2, K4, K6 and K8: Only the ball in row 4, column 4 falls down.

Right end position

Plate K2 by itself: all balls in rows 1 and 3 fall down.

Plates K2 and K4: All balls in row 1 fall down.

Plates K2, K4 and K6: The balls in row 1 columns 1 and 3 fall down.

Plates K2, K4, K6 and K8: The ball in row 1 column 1 falls down.

The table according to FIG. 18 illustrates all the combinations of the plate positions for allowing only a single ball to fall down ("free ball"). When four plates K2, K4, K6 and K8 are used, where each plate has sixteen combination openings, blockage is obtained for all balls except the one selected. By selecting only three plates two balls in any row or column can be caused to fall down and thus obtain contact for two seperate connections.

FIGS. 19 and 20 are views from one side of the positions of the combination plates for two different cases according to the table in FIG. 18.

The opening 11 in the combination plate K2 according to FIG. 14 can be replaced with an oval, symmetrical opening of the same shape as the openings of the lifting plates L1, L2, but with a height equal to the height of the opening 11 and with a width equal to the greatest width of the opening 11. Here the ball having a position corresponding to the opening 11 (now oval)

will fall down in front of the associated cavity irrespective of what combination remaining plates K4–K8 are placed in. This enables obtaining a conductive (or non-conductive) contact at an intersection point simultaneously with contact in one of the remaining intersection points, independent of its position in the connection matrix. This possibility is of great value in telephone connections, since a switching function can be easily obtained in this way.

I claim:

1. A matrix crosspoint switching device for making, breaking or switching contacts between a plurality of first conductor pairs and a plurality of second conductor pairs, conductors in first sets of said first pairs and conductors in first sets of said second pairs forming a first matrix of crosspoints and conductors in second sets of said first and second pairs forming a second matrix of crosspoints, each of said crosspoints in said first and second matrices including a contact area in a connection block, said connection block including a plurality of cavities extending from one side of said connection block to the opposite side of said connection block, the crosspoints of said first matrix occupying first end spaces of said cavities and the crosspoints of said second matrix occupying second opposite end spaces of said cavities on either side of the symmetry axis of said connection block, a first and a second pair of roller elements movably disposable within each cavity, one of said roller elements in each pair being electrically conductive while the other one is non-conductive, such that said one element in each pair is able to achieve electrically conductive contact when moved into contact with a contact area and such that said other element in said pair is unable to achieve electrically conductive contact when moved into contact with a contact area;

the device further including control means for controlling the movements of said roller elements, sand control means including on each side of said connection block first and second positioning means for positioning said roller elements in front of said cavities, a first and a second plurality of apertured combination plate means, and actuation means to actuate predetermined ones of said roller elements based on the relative positions of said combination plate means to attain a selective connection or disconnection of determined crosspoints in said first and second matrices.

2. A matrix crosspoint switching device as claimed in claim 1, wherein said roller elements are spherical balls.

3. A matrix crosspoint switching device as claimed in claim 2, wherein means are disposed in each of said cavities for transferring the movement of one pair of roller elements when actuated to the other pair of roller elements in the same cavity.

4. A matrix crosspoint switching device as claimed in claim 3, wherein said means include one ball in the first pair and one ball in the second pair.

5. a matrix crosspoint switching device as claimed in claim 1, wherein said contact areas each include a first pair of spring contact surfaces of said first conductor pair and a second pair of spring contact surfaces of said second conductor pair arranged in a cavity on either side of said symmetrical axis.

6. A matrix crosspoint switching device as claimed in claim 1, wherein said contact areas each include a first pair of spring contact surfaces of said first conductor pair and a second fixed contact surface of said second conductor pair arranged in a cavity on either side of said symmetrical axis.

7. A matrix crosspoint switching device as claimed in claim 4, wherein said contact areas comprise wire pairs for each contact area, each pair being arranged perpendicular to each other and perpendicular to the longitudinal direction of the cavity to form a substantially quadratic window in front of an opening to the cavity, the dimensions of said window being such that a ball may be held by said wire pairs within said window.

8. A matrix crosspoint switching device as claimed in claim 1, wherein each of said cavities comprises a first cylindrical hole extending from one side surface of the block, and a second cylindrical hole extending from the opposite side surface of the block, both of said cylindrical holes extending a distance into said block at right angles to the side surfaces and past said symmetrical axis such that the axes of said holes are in the same plane but are displaced up to one hole diameter from each other.

9. A matrix crosspoint switching device as claimed in claim 5, wherein said first pairs of spring contact surfaces include a plurality of parallel ribbons fixedly arranged transversely within the connection block level with each cavity, wherein each of said ribbons is provided with a plurality of tongues which extend into the respective cavity to form one of said spring surfaces.

10. A matrix crosspoint switching device as claimed in claim 6, wherein said second fixed contact surfaces include a plurality of parallel ribbons within the connection block fixedly arranged in a longitudinal direction thereof, wherein each of said ribbons includes tongues projecting out in the transverse direction of the connection block, said tongues being fixedly arranged on upper surfaces of said cavities at said first end spaces and on lower surfaces of said cavities at said second end spaces to form said fixed contact surfaces.

11. A matrix crosspoint switching device as claimed in claim 3, wherein said cavities are cylindrical and each of said balls has a diameter smaller than the diameter of the cylindrical cavity, said movement transferring means being so dimensioned that when said one pair of balls is entirely within said cavity, one ball of said other pair of balls is outside said cavity.

12. A matrix crosspoint switching device as claimed in claim 1, wherein said first and second positioning means each comprised a first and a second lifting plate disposed adjacent and parallel to a side surface of said connection block for moving one of said roller elements toward and away from a first position in front of an opening of one of said cavities, and wherein said apertured combination plate means includes a plurality of plates provided with apertures and placed between said first and second lifting plates on both sides of the connection unit, and means for displacing the plates in a direction parallel to the side surfaces of the block perpendicular to the movement of said lifting plates, said apertures forming an opening for a selected roller element such that the selected roller element is movable towards the opening of one of said cavities by said actuation means in order to displace the other roller element in the pair of roller elements.

* * * * *